US009743732B1

(12) United States Patent
Busby

(10) Patent No.: US 9,743,732 B1
(45) Date of Patent: Aug. 29, 2017

(54) SAFETY EYEGLASS CASE AND MOUNTING BRACKETS

(71) Applicant: John T. Busby, St. Joseph, MO (US)

(72) Inventor: John T. Busby, St. Joseph, MO (US)

( * ) Notice: Subject to any disclaimer, the term of this patent is extended or adjusted under 35 U.S.C. 154(b) by 0 days.

(21) Appl. No.: 14/840,123

(22) Filed: Aug. 31, 2015

Related U.S. Application Data

(63) Continuation-in-part of application No. 14/072,271, filed on Nov. 5, 2013, now abandoned.

(51) Int. Cl.

| | |
|---|---|
| ***A45C 11/04*** | (2006.01) |
| ***F16M 13/02*** | (2006.01) |
| ***A45C 13/00*** | (2006.01) |
| ***A45C 13/10*** | (2006.01) |

(52) U.S. Cl.
CPC ..... *A45C 11/04* (2013.01); *A45C 13/005* (2013.01); *A45C 13/10* (2013.01); *F16M 13/02* (2013.01)

(58) Field of Classification Search
CPC ..... A45C 11/04; A45C 13/02; A45C 13/00; A45C 13/10; A45C 13/005; F16M 13/02
USPC ..... 224/323, 319, 412, 419, 430, 431, 428; 248/213, 211, 214, 215, 229.24, 230.5, 248/231.61, 309.1, 176.1; 206/5, 6
See application file for complete search history.

(56) References Cited

U.S. PATENT DOCUMENTS 2,455,079 A * 11/1948 Mercer ..... A45C 11/04 206/37
2,522,909 A * 9/1950 Wadanoli ..... A47G 29/08 206/233
2,574,007 A * 11/1951 Anderson ..... 24/326
2,692,043 A * 10/1954 Davis ..... A45C 11/04 206/38
2,735,597 A * 2/1956 Treleven ..... B60R 7/082 206/5
2,809,766 A * 10/1957 Anderson ..... A45C 11/04 206/6
3,089,500 A * 5/1963 Stalcup ..... A45C 11/005 134/115 R
3,323,638 A * 6/1967 Dishart ..... A45C 11/04 132/148
4,193,525 A 3/1980 Sommers
D266,205 S 9/1982 Berman
4,574,944 A * 3/1986 Gregory ..... A45C 13/34 132/316
4,865,186 A * 9/1989 Gates ..... A45C 11/046 206/5
5,016,749 A * 5/1991 Kaye ..... A45C 11/046 206/5

(Continued)

FOREIGN PATENT DOCUMENTS

EP 0417419 3/1991
GB 2499028 A * 8/2013 ..... A42B 3/0406

*Primary Examiner* — Kimberly Wood
(74) *Attorney, Agent, or Firm* — Robert C. Montgomery; Montgomery Patent & Design LP.

(57) ABSTRACT

A case is provided having a hingedly attached lid and at least one (1) base bracket affixed thereto. A securing mounting bracket is capable of joining to an individual base bracket via a fastening means. Each base bracket and mounting bracket create a passageway to accommodate operatively attaching the case to a support structure. A user then has safety eyeglasses stored with the tool for immediate disposal and access. A means to secure safety earplugs within the case also exists.

20 Claims, 8 Drawing Sheets

(56) References Cited

U.S. PATENT DOCUMENTS 5,181,774 A * 1/1993 Lane ..... B62J 6/02 224/421
5,193,774 A 3/1993 Rogers
5,312,029 A * 5/1994 Tuber ..... A45C 11/04 224/241
5,440,458 A * 8/1995 Volk ..... F21V 33/0068 206/5.1
5,921,383 A * 7/1999 Shefler ..... A45C 11/04 206/38
D414,036 S 9/1999 Conway
6,053,309 A * 4/2000 Lin ..... A45C 11/04 206/6
6,494,427 B1 12/2002 Smith
6,575,652 B2 6/2003 Krauss
6,728,995 B2 * 5/2004 Ainley ..... B60R 7/05 24/3.3
6,729,467 B1 * 5/2004 King ..... A45C 11/04 206/5
6,938,865 B1 * 9/2005 Day ..... B60R 11/02 248/229.14
D551,862 S 10/2007 Gerry
7,350,755 B1 * 4/2008 Harrison ..... B63B 17/00 248/214
7,628,372 B2 * 12/2009 Norman ..... B60R 1/0605 248/214
7,934,595 B2 * 5/2011 Breit ..... A45C 11/04 206/5
D648,528 S 11/2011 Liebers
8,083,192 B2 12/2011 Wells et al.
9,065,921 B2 * 6/2015 Merenda ..... B65H 75/48
2012/0325879 A1 12/2012 Olschansky
2013/0233730 A1 * 9/2013 Crescenzi ..... A45C 11/04 206/5
2016/0050774 A1 * 2/2016 Merenda ..... H05K 5/0086 224/162

* cited by examiner

SAFETY EYEGLASS CASE AND MOUNTING BRACKETS

RELATED APPLICATIONS

The present invention is a Continuation-in-part of and claims the benefit of U.S. application Ser. No. 14/072,271, filed Nov. 5, 2013, the entire disclosures of which are incorporated herein by reference.

FIELD OF THE INVENTION

The present invention relates to a safety eyeglass case and accompanying mounting brackets to secure the case to a power tool and thereby stow safety glasses in a convenient manner for ready and immediate access.

BACKGROUND OF THE INVENTION

The use of safety glasses or protective eyewear has increased in both work and industrial environments. They are no longer only seen at construction sites and industrial establishments throughout the country, but at homes and commercial environments as well. Their use has resulted in reduced eye injuries, and an overall improvement in safety. One (1) area in which eyewear is typically used, or should be used, is when operating a string style trimmer when performing landscaping, or yard work. The possibility of grass clippings, stones, twigs, and the like, being thrown up into the operator's eyes is very real. One (1) of the most frequently heard excuses as to why an operator will not wear safety glasses is that they cannot be found, they are lost, or they take too long to go and get them. Then, when they are found, they are broken, scratched, or otherwise damaged. Accordingly, there exists a need for a means by which safety glasses can be provided in more ready access to be more easily and properly utilized when operating a string style trimmer or similar power tool.

SUMMARY OF THE INVENTION

The case and mounting bracket of the present invention is a safety glasses storage case designed to mount to the cylindrical shaft of a string-style trimmer or similar power tool. Upon initial observation of a string-style weed trimmer equipped with the present invention, nothing appears readily different. However, after closer inspection, it can be seen that there is a safety eyeglass case mounted to the shaft of the weed trimmer near the shaft handle grip. The case has a hinged lid that snap locks closed and will hold one (1) pair of safety eyeglasses complete with side shields. There also exists a means to secure a set of safety earplugs within the case as well. The case is capable of being attached to the shaft of the trimmer using the attached mounting brackets that are sized to fit a variety of circular power tool shafts, but may also be adapted to fit other shaft shapes as well. These features ensure that safety glasses will always be readily available when beginning operation of the power tool, and provides a handy place for storage where they will not get damaged or scratched.

In a preferred embodiment of the invention, the case has a bottom wall that has integral hemispherical-shaped base brackets, each capable of mating with a mounting bracket segment of a mounting bracket assembly, possessing a similar hemispherical shape. The arcuate mating sides of both the base brackets and mounting bracket segments are capable of conforming to an outer circumference of a cylindrical shaft of a work tool. Fasteners mate an aligned individual base bracket and mounting bracket segment pair.

In another embodiment of the invention, at least one (1) cylindrical receptacle is affixed within the interior of the case. Each holder is capable of retaining a conventional foam safety earplug therewithin.

In yet another embodiment of the invention, a first mounting bracket assembly differs from a second mounting bracket assembly in that a first mounting bracket segment is longer than the second mounting bracket segment. Such an additional length accommodates a bracket aperture, capable of either accepting another mounting means to mount the case to a different support structure, or for enabling routing of a hasp of a lock therethrough to prevent unauthorized removal of the case from the support structure.

Thus, when the present invention meets the need for a way to keep and store protective safety eyeglasses and safety earplugs when not using the tool, but also keeps them at ready access in an immediate location to encourage their consistent use, which results in better safety and protection for the operator.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
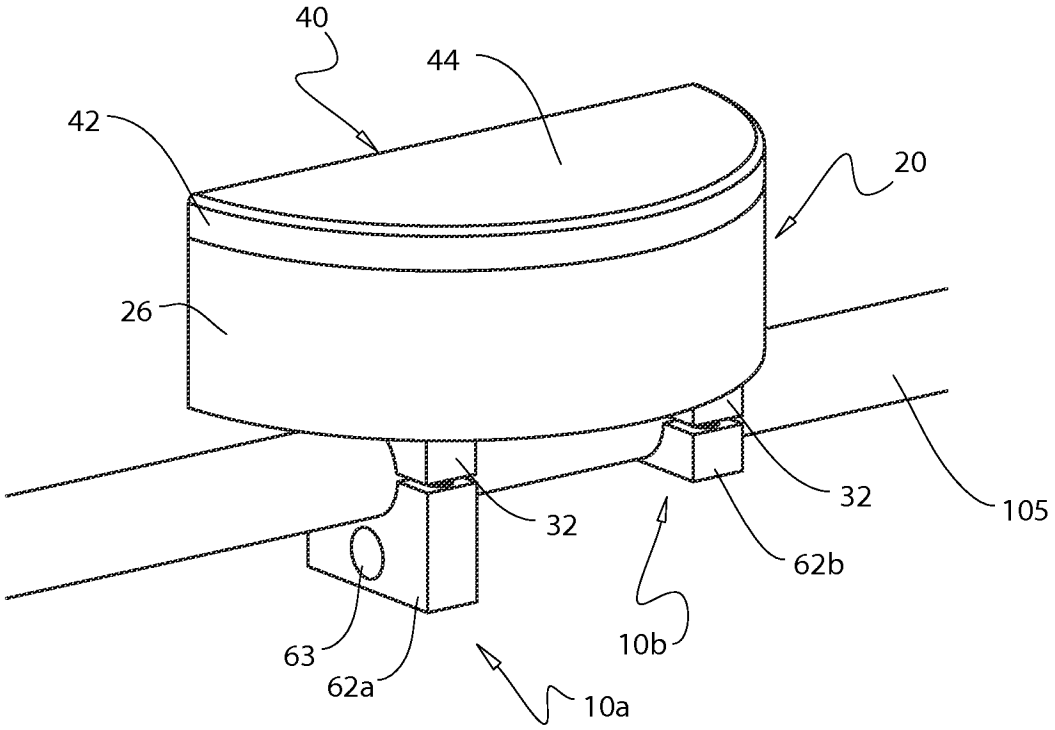
FIG. 1 is an isometric view of a safety eyeglass case 20 with mounting bracket assemblies 10*a*, 10*b* affixed to a round shaft of a work tool 105 in accordance with the preferred embodiment of the present invention.

10*a* first mounting bracket assembly
10*b* second mounting bracket assembly
20 case

23 case rear wall
24 case bottom wall
26 case side wall
32 bracket base
34 base passageway
36 channel
40 lid upper wall
42 lid sidewall
43 lid rear wall
44 lid
52 hinge
54 interior
62*a* first lower bracket segment
62*b* second lower bracket segment
63 bracket aperture
64 bracket passageway
66 bracket aperture
71 fastener
80 earplug holder
100 safety eyeglasses
101 safety earplugs
105 shaft

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a safety eyeglass case 20 with mounting bracket assemblies 10*a*, 10*b* (herein referred to as the "case"), which provides a means to retain a pair of safety eyeglasses 100 within the interior 54 of the case 20 that is mounted to the shaft 105 of a support structure such as a work tool so that said safety eyeglasses 100 are available for use by the tool user. There is also means within the interior 54 of the case 20 for the additional retention of a pair of collapsible foam safety earplugs 101.

Referring now to FIG. 1, an isometric view of the case 20 according to the preferred embodiment of the present invention, is disclosed. The case 20 also includes a lid 40 generally coextensive with an upper perimeter edge of the case side wall 26. A preferred embodiment of the case 20 and lid 40 is in a hemispherical configuration to generally match the profile of convention pair of safety eyeglasses 100 also having a general hemispherical shape. This preferred embodiment is efficient in that it minimizes the amount of wasted space in order to limit instances where the case 20, as attached the shaft 105 of a work tool, may be snagged or otherwise impeded normal use of the work tool.

The lid 40 and case 20 are constructed preferably of a rigid thermoplastic, or other such material, as two (2) individual parts in an injection molding process. The case 20 includes an arcuate case sidewall 26, a planar case rear wall 23, and a planar case bottom wall 24 to form an interior 54 of sufficient volume for the storage of a pair of safety eyeglasses 100. The case sidewall 26 conjoins along all abutting edges of the case rear wall 23 and case bottom wall 24. At least one (1), and preferably a pair, of earplug holders 80 are affixed to the inner surface of the case bottom wall 24 and extend upward into the interior 54. The holders 80 are cylindrical receptacles and are preferably located along a common centerline of the case bottom wall 24. The preferred location of the holders 80 enable a pair of safety eyeglasses 100 can be placed in the case and not be interfered with by the holders 80. The cylindrical receptacle shape of each holder 80 enables a convention foam safety earplug 80 to be inserted therein, wherein the deforming aspect of the foam safety earplugs 101 enable a frictional secure fit therewithin.

Figure 4:
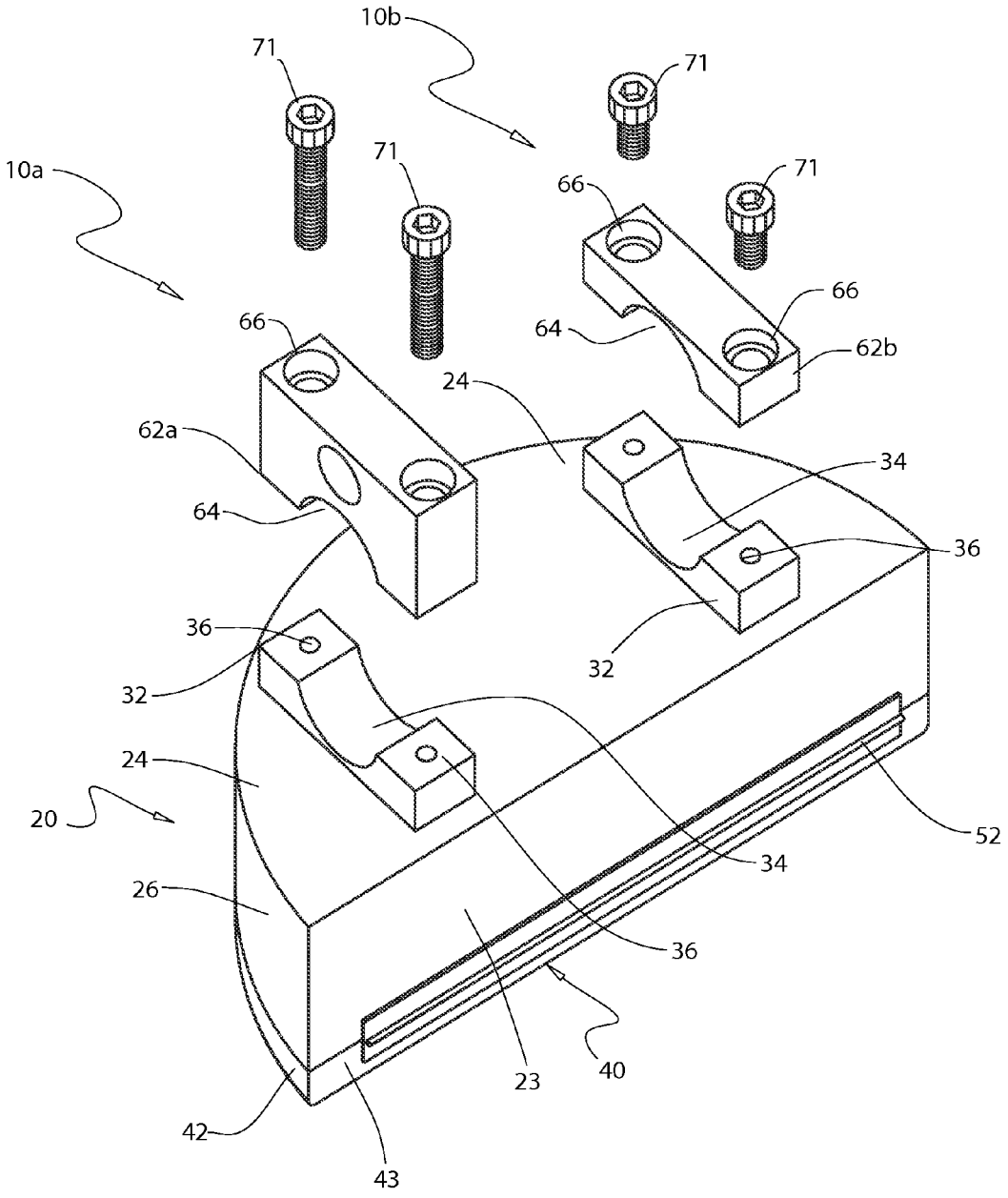
FIG. 4 is an isometric view of the bottom of the safety eyeglass case 20 depicted with an exploded view of the mounting bracket assemblies 10*a*, 10*b* and fasteners 71 in accordance with the preferred embodiment of the present invention.
Figure 5:
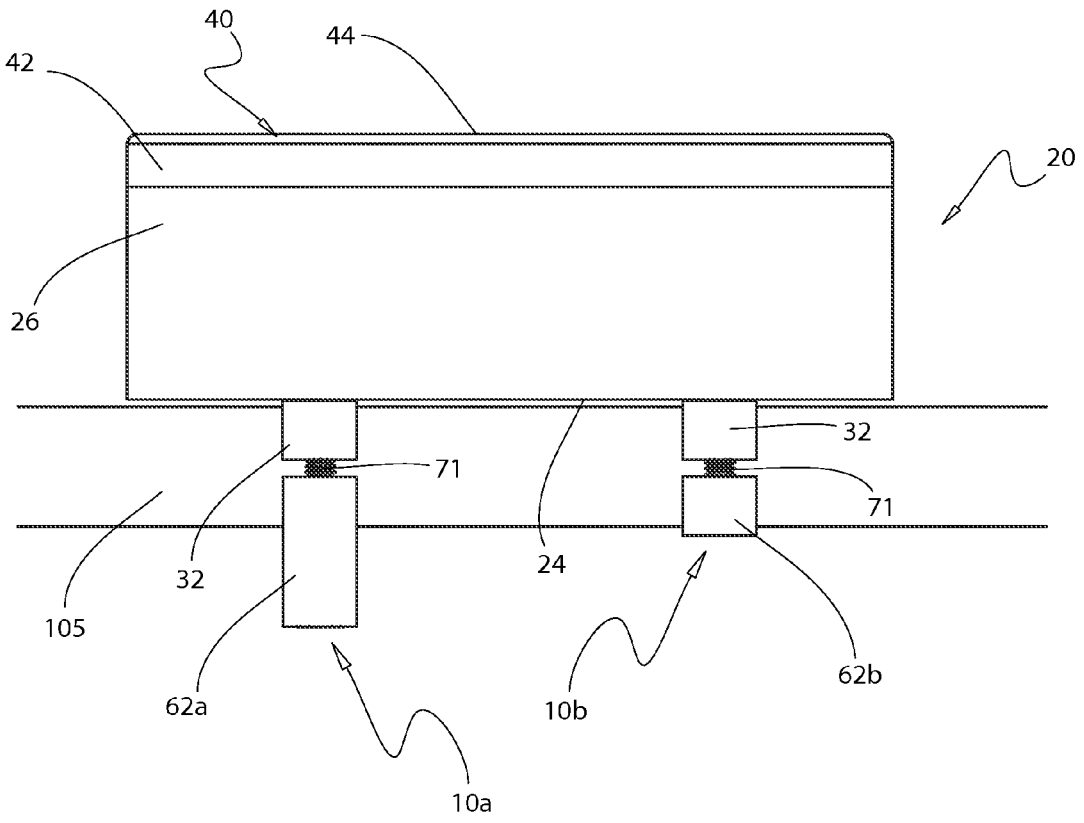
FIG. 5 is a front elevation view of the safety eyeglass case 20 with the mounting bracket assemblies 10*a*, 10*b* installed thereon, in accordance with the preferred embodiment of the present invention.
Figure 6:
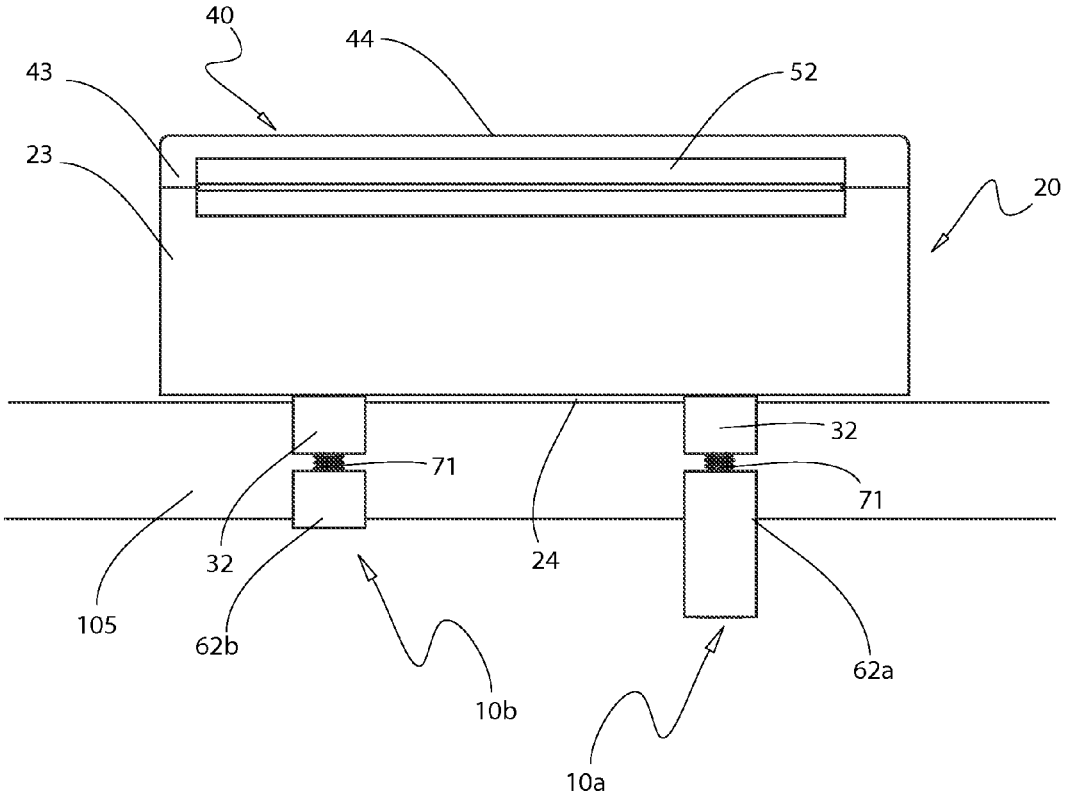
FIG. 6 is a rear elevation view of the safety eyeglass case 20 with the mounting bracket assemblies 10*a*, 10*b* installed thereon, in accordance with the preferred embodiment of the present invention.
Figure 7:
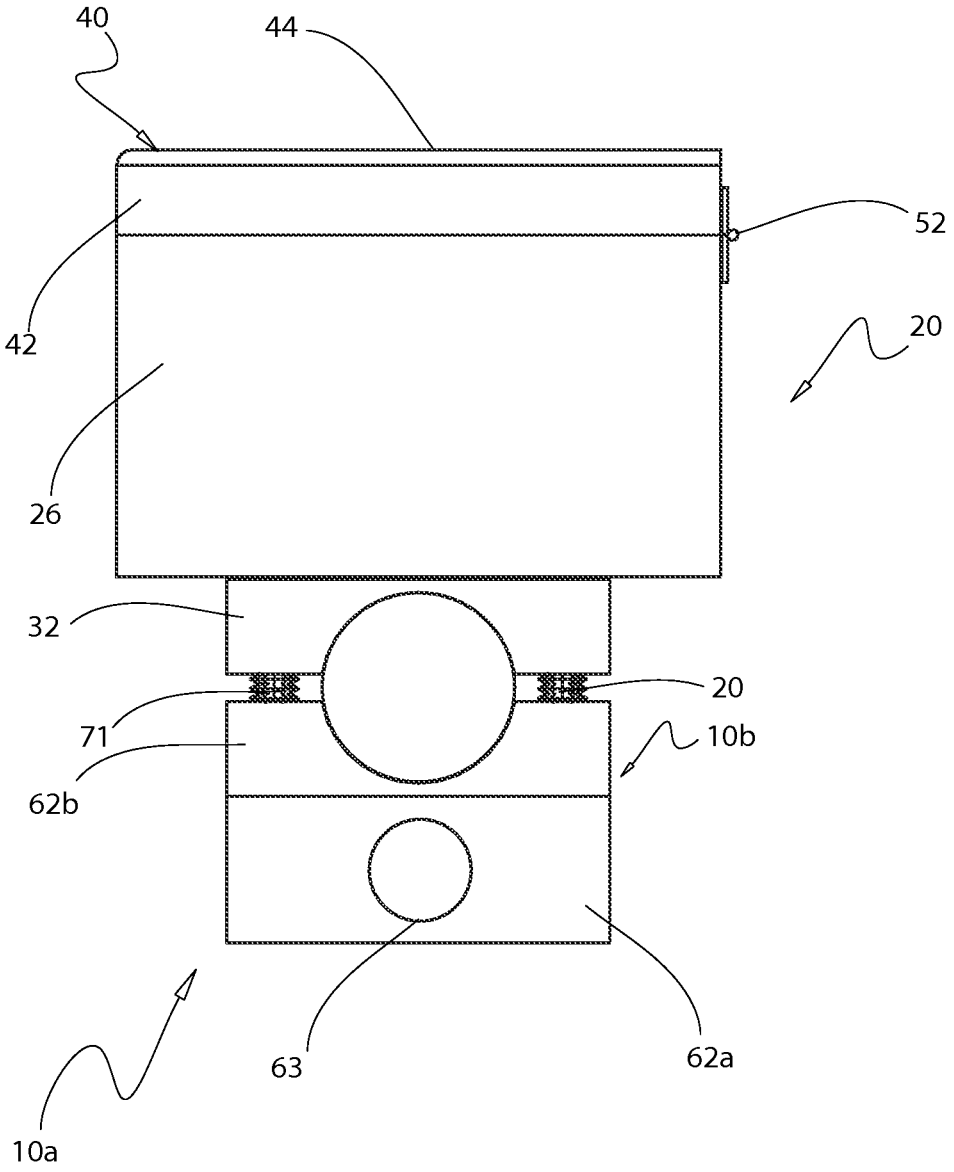
FIG. 7 is a right side elevation view of the safety eyeglass case 20 with the mounting bracket assemblies 10*a*, 10*b* installed thereon, in accordance with the preferred embodiment of the present invention; and, FIG. 8 is a left side elevation view of the safety eyeglass case 20 with the mounting bracket assemblies 10*a*, 10*b* installed thereon, in accordance with the preferred embodiment of the present invention.
Figure 8:
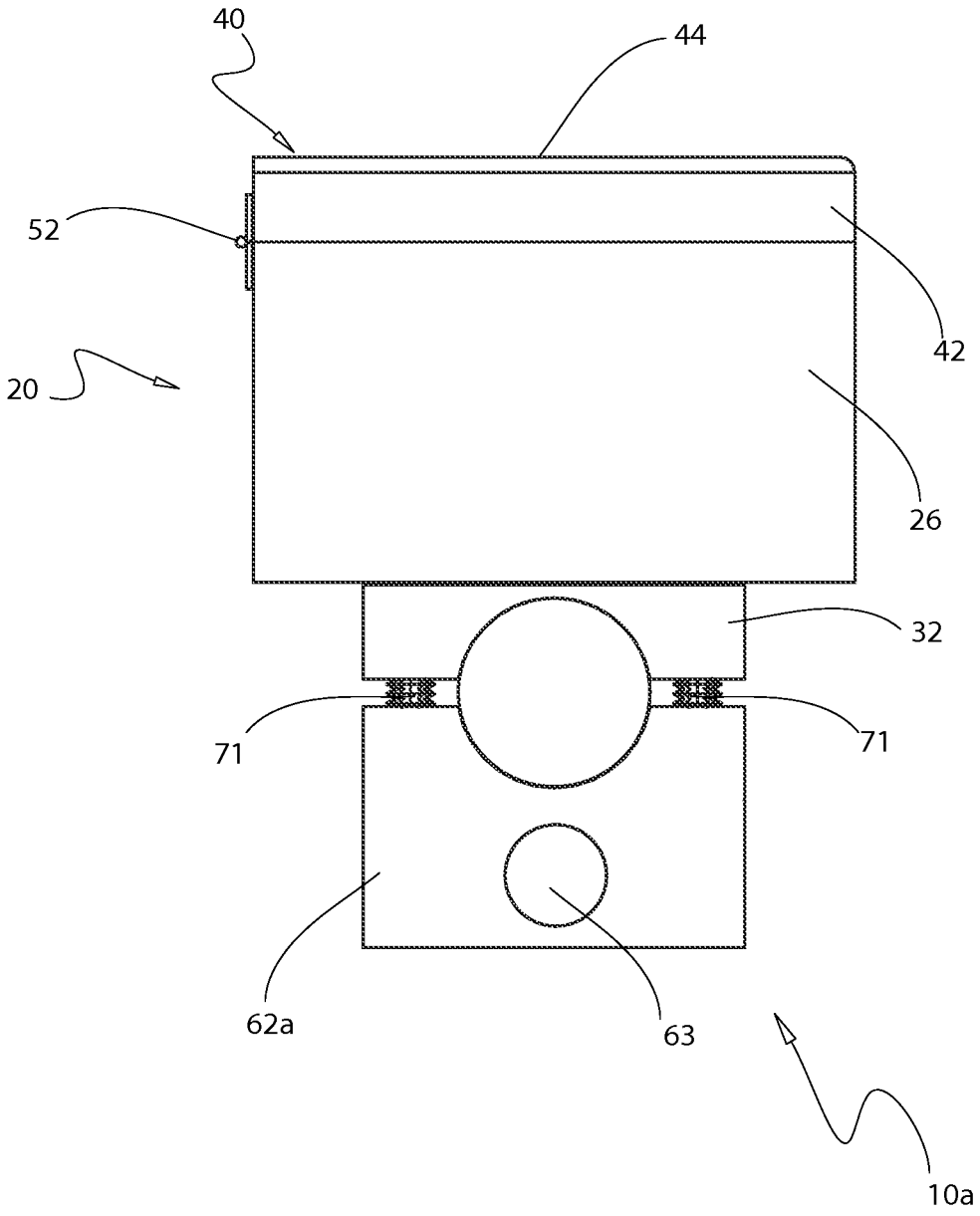

The case bottom wall 24 incorporates two (2) bracket base 32 portions in a unitary construction. The bracket base portions 32 are aligned along a common centerline of the case bottom wall 24 and are capable of mating to one (1) of the first and second mounting bracket assemblies 10*a*, 10*b* via a fastener 71 removably placed within a channel 36 passing through the thickness of the bracket base 32. More than one (1) channel 36 may exist. As best illustrated in FIG. 4, each bracket base 32 is provided with a base passageway 34 which is a hemispherical void in said bracket base 32 capable of conforming to the cylindrical shaft 105 of the work tool. In some embodiments the case bottom wall 24 may have contours other than a strictly planar configuration without limiting the scope of the case 20.

The lid 40 is much thinner than the case 20, yet generally has a coextensive shape thereof. The lid 40 includes an arcuate lid sidewall 42, a planar lid rear wall 43, and a planar lid upper wall 44. The lid sidewall 42 conjoins along all abutting edges of the lid rear wall 43 and lid upper wall 44.

Figure 2:
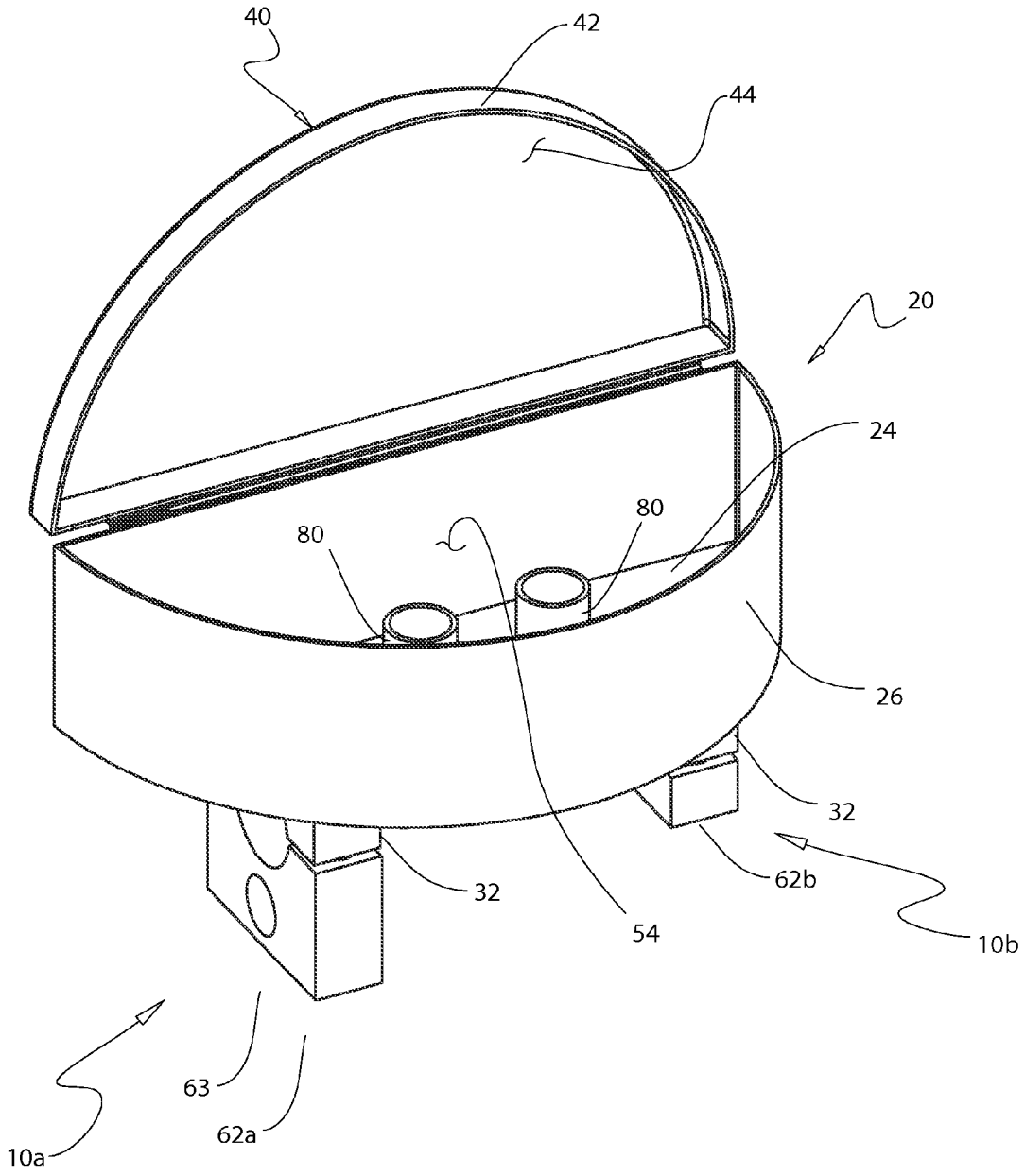
FIG. 2 is an isometric view of an open safety eyeglass case 20 showing the interior 54 thereof, in accordance with the preferred embodiment of the present invention.
Figure 3:
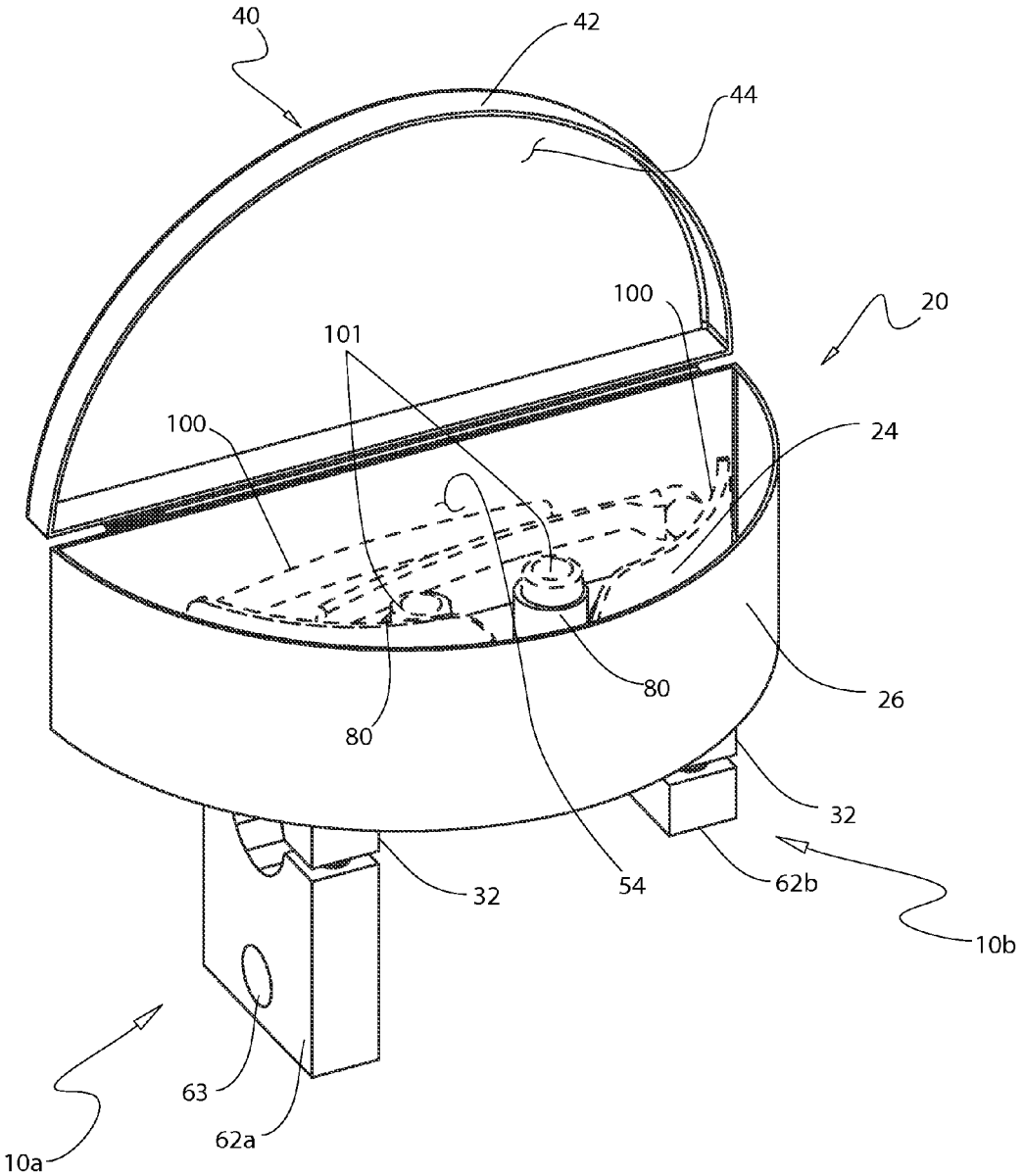
FIG. 3 is another isometric view of an open safety eyeglass case 20 showing safety glasses 100 and safety earplugs 101 installed therein, in accordance with the preferred embodiment of the present invention.

Referring now to FIGS. 2 and 3, isometric views of the case 20 in an open configuration both empty and filled with commonly used safety equipment, such as safety eyeglasses 100 and safety earplugs 101, is disclosed. The lid rear wall 43 and the case rear wall 23 are attached to opposite leaves of a hinge 52 preferably by means of rivets, or other such fasteners, in order to enable the lid 40 to be hingedly attached to the case 20. The lid 40, when fully closed against the case 20, fully covers the interior 54 of the case 20. The hinge 52 would preferably incorporate a spring, or spring like device to hold the case 20 in a closed configuration.

As best illustrated in FIG. 4, the lower bracket segments 62*a*, 62*b* of the bracket assemblies 10*a*, 10*b* are each comprised preferably of a rigid thermoplastic, or other such material and formed with a bracket passageway 64 similar to the base passageway 34 in the bracket base 32 pieces previously discussed. When each bracket base 32 is conjoined with a corresponding lower bracket 62*a*, 62*b* the base passageway 34 and the bracket passageway 64 form a joined passageway permitting entrance of a cylindrical shaft 105 of a work tool. Disposed in the lower bracket segments 62*a*, 62*b* is at least one (1) bracket aperture 66, which, when aligned with an individual channel 36 of the base brackets 32, fasteners 71 can then clamp the case 20 to a shaft 105 of a work tool.

A preferred embodiment includes a first mounting bracket assembly 10*a* and a second mounting bracket assembly 102. The first mounting bracket assembly 10*a* differs from the second mounting bracket assembly 109*b* in that the first lower bracket segment 62*a* has a greater length than the second lower bracket segment 62*b* in order to accommodate a bracket aperture 63. The bracket aperture 63 is a passthrough channel that is capable of enabling the case 20, when attached to the first mounting means assembly 10*a* and via an external mounting means, to another location instead of a cylindrical shaft 105. The bracket aperture 63 also enables the hasp of a lock to be routed through to provide a secure locking means for the case 20 to the cylindrical shaft 105.

FIGS. 5 through 8 illustrate various views of the safety eyeglass case 20 with the mounting bracket assemblies 10*a*, 10*b* installed thereon, in accordance with the preferred embodiment of the present invention.

The preferred embodiment of the present invention can be utilized by the enabled user in a simple and straightforward manner with little or no training. After initial purchase or acquisition of the case 20, it would be installed as indicated in FIG. 1. The method of installing and utilizing the case 20 may be achieved by performing the following steps: installing the case 20 onto a shaft 105 of a work tool by fitting the shaft 105 into the base passageways 34 of each bracket base 32; fitting the bracket passageway 64 of the lower bracket segments 62*a*, 62*b* onto the shaft 105 opposite from the bracket bases 32; aligning the bracket apertures 66 with the channels 36; installing the required number of fasteners 71; repeating the procedure to complete the installation of the remaining lower bracket segments 62; and inserting a user-supplied pair of safety eyeglasses 100 into the case 20. Also, a pair of safety earplugs 101 can be secured within the holder 80 located in the interior 54 of the case 20 as desired.

Alternately, the bracket aperture 63 can be used to mount the case 20 to a different location than the shaft 105 of a work tool, or be utilized to rout a hasp of a locking device in order to prevent unauthorized removal of the case 20 from the shaft 105 of the work tool.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A case comprising:

a case body comprising a bottom wall, a rear wall and a side wall defining an interior compartment, said case body configured to retain a pair of safety eyeglasses within said compartment;

a lid operatively affixed to said rear wall of said case body to enclose said compartment;

a pair of tubular receptacles affixed to an inner surface of said bottom wall of said case body within said compartment and each of said pair of tubular receptacles comprising a cylindrical opening, each of said pair of tubular receptacles being configured to deformably receive and frictionally secure a safety earplug within said cylindrical opening, and wherein said pair of tubular receptacles are located along a centerline of said bottom wall parallel to said rear wall such that, when said pair of safety glasses are received within said compartment, lenses of said pair of safety glasses are positioned between said pair of tubular receptacles and said side wall and temples of said pair of safety glasses are positioned between said pair of tubular receptacles and said rear wall;

at least one base bracket affixed to an outer surface of said bottom wall of said case body; and at least one mounting bracket removably connected to said at least one base bracket to connect said case body to a support structure.

2. The case of claim 1, wherein said lid and said case body comprise a coextensive cross-sectional shape.

3. The case of claim 2, wherein said cross-sectional shape is hemispherical.

4. The case of claim 2, further comprising a hinge disposed between said lid and said rear wall of said case body to allow said lid to pivot relative to said rear wall of said case body between an open disposition and a closed disposition.

5. The case of claim 1, wherein said at least one base bracket comprises a pair of base brackets aligned along a common axial centerline of said bottom wall, and wherein said at least one mounting bracket comprises a pair of mounting brackets.

6. The case of claim 5, wherein each base bracket comprises at least one side having a semi-circular face.

7. The case of claim 6, wherein each mounting bracket comprises at least one side having a semi-circular face.

8. The case of claim 7, wherein said semi-circular of said base bracket and said semi-circular face of said mounting bracket form a circular aperture when said mounting bracket is aligned with and connected to said base bracket.

9. The case of claim 1, wherein said at least one base bracket comprises at least one base channel and said at least one mounting bracket comprises at least one mounting channel, and wherein said base channel and said mounting channel receive a fastener to connect said mounting bracket to said base bracket.

10. A case assembly comprising:

a pair of safety glasses comprising lenses and a pair of temples pivotably connected to said lenses;

a pair of safety ear plugs;

a case body comprising a bottom wall, a rear wall and a side wall defining an interior compartment, said case body configured to retain said pair of safety eyeglasses within said compartment;

a lid operatively affixed to compartment said rear wall of said case body to enclose said;

a pair of tubular receptacles affixed to an inner surface of said bottom wall of said case body within said compartment and each of said pair of tubular receptacles comprising a cylindrical opening, each of said pair of tubular receptacles being configured to deformably receive and frictionally secure one of said pair of safety earplugs within said cylindrical opening, and wherein said pair of tubular receptacles are located along a centerline of said bottom wall parallel to said rear wall such that, when said pair of safety glasses are received within said, said lenses of said pair of safety glasses are positioned between said pair of tubular receptacles and said side wall and said temples of said pair of safety glasses are positioned between said pair of tubular receptacles and said rear wall;

a first base bracket and a second base bracket, each affixed to an outer surface of said bottom wall of said case body;

a first mounting bracket removably connected to said first base bracket to partially connect said case body to a support structure, said first mounting bracket comprising a bracket aperture;

a second mounting bracket removably connected to said second base bracket to partially connect said case body to said support structure;

a first fastener to secure a first aligned pair of said first base bracket and said first mounting bracket together; and, a second fastener to secure a second aligned pair of said second base bracket and said second mounting bracket together.

11. The case of claim 10, wherein said lid and said case body comprise a coextensive cross-sectional shape.

12. The case of claim 11, wherein said cross-sectional shape is hemispherical.

13. The case of claim 11, further comprising a hinge disposed between said lid and said rear wall of said case body to allow said lid to pivot relative to said rear wall of said case body between an open disposition and a closed disposition.

14. The case of claim 10, wherein said first and second aligned pairs are aligned along a common axial centerline of said bottom wall.

15. The case of claim 14, wherein said first and second base bracket each comprise at least one side having a semi-circular face.

16. The case of claim 15, wherein said first and second mounting bracket each comprise at least one side having a semi-circular face.

17. The case of claim 16, wherein said semi-circular faces of each said first and second aligned pair form a circular aperture.

18. The case of claim 10, wherein said first and second base bracket and said first and second mounting bracket each comprise at least one channel to receive said first fastener to connect said first aligned pair of said first base bracket and said first mounting bracket together and said second fastener to connect said second aligned pair of said second base bracket and said second mounting bracket together.

19. The case of claim 4, wherein said hinge comprises a spring configured to operatively bias said lid in said closed configuration.

20. The case of claim 13, wherein said hinge comprises a spring configured to operatively bias said lid in said closed configuration.

* * * * *